US006557915B1

(12) United States Patent
Duff

(10) Patent No.: US 6,557,915 B1
(45) Date of Patent: May 6, 2003

(54) PORTABLE DOORSTOP WITH ERGONOMIC ADVANTAGES

(75) Inventor: Robert O. Duff, Farmington, MN (US)

(73) Assignee: Duff's Door Stopper, Farmington, MN (US)

( * ) Notice: Subject to any disclaimer, the term of this patent is extended or adjusted under 35 U.S.C. 154(b) by 0 days.

(21) Appl. No.: 09/909,434

(22) Filed: Jul. 19, 2001

Related U.S. Application Data

(60) Provisional application No. 60/240,724, filed on Oct. 16, 2000.

(51) Int. Cl.[7] ..... E05C 17/54
(52) U.S. Cl. ..... 292/343; 292/DIG. 15
(58) Field of Search ..... 292/342, 343, 292/338, 339, DIG. 15; 16/82

(56) References Cited

U.S. PATENT DOCUMENTS 1,119,650 A * 12/1914 Smith
1,939,402 A * 12/1933 Moser ..... 292/343
3,124,382 A * 3/1964 Strother ..... 292/343
3,143,369 A * 8/1964 Adams ..... 292/288
4,607,253 A * 8/1986 Wooten ..... 340/546
4,883,297 A * 11/1989 Smith ..... 292/339
5,217,269 A * 6/1993 Wiltberger ..... 292/343
5,787,548 A * 8/1998 Tzen ..... 16/82
6,085,766 A * 7/2000 Geary ..... 135/75

FOREIGN PATENT DOCUMENTS

GB 2279108 * 12/1994 ..... E05C/17/54

* cited by examiner

*Primary Examiner*—Gary Estremsky
(74) *Attorney, Agent, or Firm*—Kinney & Lange, P.A.

(57) ABSTRACT

A doorstop having a telescoping handle and a foot mounted at a lower end of the handle. The handle of the doorstop has a length that allows a user to insert the foot under a lower edge of a door and to remove the foot from under the lower edge without requiring the user to bend over.

14 Claims, 8 Drawing Sheets

PORTABLE DOORSTOP WITH ERGONOMIC ADVANTAGES

CROSS-REFERENCE TO RELATED APPLICATION(S)

This application claims priority from provisional application No. 60/240,724 filed Oct. 16, 2000, for "PORTABLE DOORSTOP WITH ERGONOMIC ADVANTAGES" by Robert O. Duff.

BACKGROUND OF THE INVENTION

The present invention relates to a portable doorstop having ergonomic advantages.

Doorstops are used in various professions and in everyday use for holding a door open. Most doorstops are placed under a lower edge of the door by an individual who must bend over to place the doorstop into position. The doorstop is then often kicked into position under the door to hold the door into place. Kicking the doorstop into place under the lower edge of the door causes damage to the door. However, not using a doorstop causes scratches and damage to the door by an object being forced through the doorway.

In certain professions such as maintenance, delivery and janitorial, propping a door open with the doorstop is done many times in one day. The repeated action of bending down to the floor to place the doorstop puts a stress on the individual's back. Thus, repeated use of a doorstop can lead to back injuries for the individual. Some persons, such as the elderly or handicapped are unable to bend down to place a doorstop to hold a door open and often lack other means for holding the door open.

There is a need for a doorstop that is portable and can be used by an individual multiple times a day, has ergonomic advantages preventing back injuries or bending down, does not damage the door and is easy to use.

BRIEF SUMMARY OF THE INVENTION

The present invention is a doorstop. Which includes a telescoping handle and a foot mounted at a lower end of the handle. Preferably, the handle has a length that allows a user to insert the foot under a lower edge of a door and to remove the foot from under the lower edge without requiring the user to bend over.

In one preferred embodiment of the doorstop, the handle comprises an inner tube having an upper end and a lower end. The lower end of the inner tube is mounted to the foot of the doorstop and the upper end has a hole. A spring pin is disposed within the inner tube and extends through the hole of the inner tube. An outer tube slides over the inner tube and is slidable between a collapsed position and at least one extended position. Preferably, the spring pin secures the outer tube in either the collapsed position or the extended position.

In another preferred embodiment of the doorstop, the foot is comprised of three portions. A first sloped portion is located at one end of the foot and a second sloped portion is located at an opposite end of the foot. The second sloped portion preferably has a different slope than the first sloped portion. A central portion is raised between the first and second sloped portions and the central portion has a vertical bore adapted for receiving the lower end of the handle.

DETAILED DESCRIPTION

Figure 1:
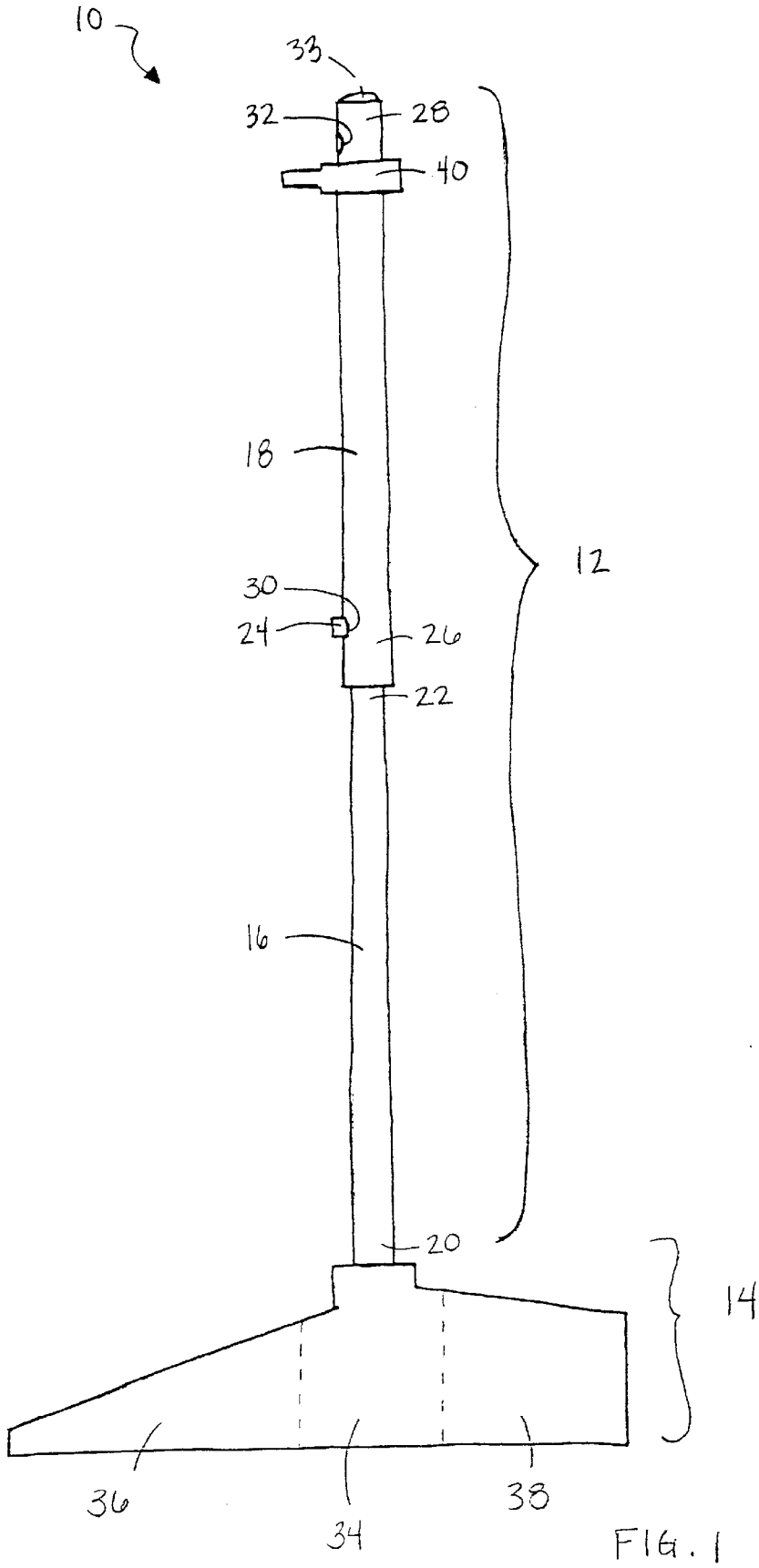
FIG. 1 is a side view of a doorstop in an extended position.

The present invention is a portable doorstop with ergonomic advantages. FIG. 1 shows a side view of a doorstop 10 in an extended position. The doorstop includes a telescoping handle 12 and a foot 14.

Handle 12 includes an inner tube 16 and outer tube 18 that slides over inner tube 16. Outer tube 18 is slidable between a collapsed position (shown in FIG. 2) and the extended position. Inner tube 16 has a lower end 20 and an upper end 22. Lower end 20 of inner tube 16 is inserted into a bore (not shown) in the top of foot 14. Preferably, inner tube 16 has its lower end 20 attached to foot 14 by an adhesive, such as epoxy.

A spring pin 24 is disposed within upper end 22 of inner tube 16. Spring pin 24 extends through a hole (not shown) in upper end 22 of inner tube 16.

Outer tube 18 slides over inner tube 16 to provide a telescoping action. Outer tube 18 has a lower end 26 and an upper end 28. Lower end 26 of outer tube 18 has a lower hole 30. Upper end 28 of outer tube 18 has an upper hole 32. An end cap 33 is fastened to upper end 28 of outer tube 18.

Figure 2:
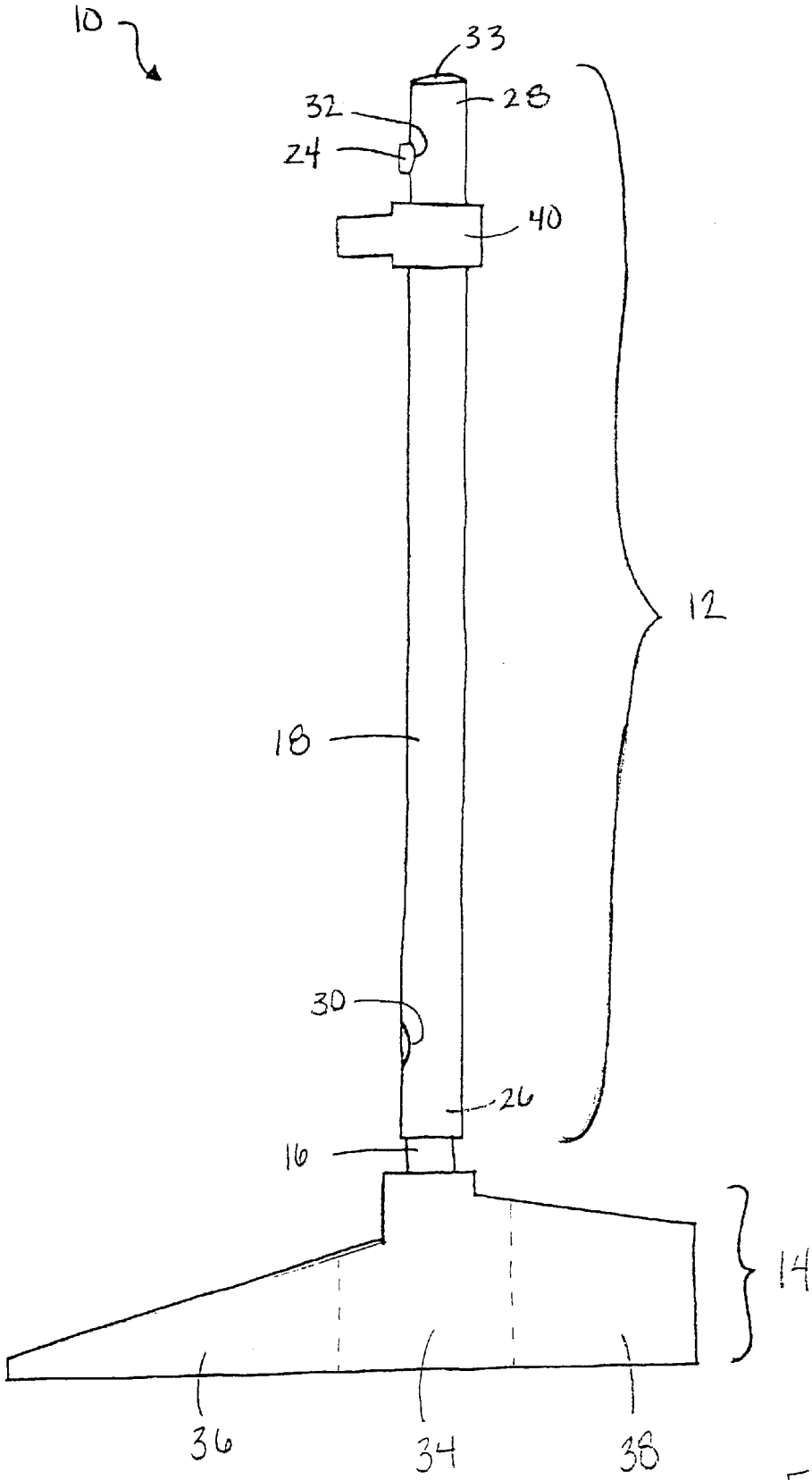
FIG. 2 is a side view of a doorstop in a collapsed position.

Spring pin 24 can snap into either lower hole 30 or upper hole 32 to hold outer tube 18 in a fixed position. When lower hole 30 is aligned with spring pin 24 (as seen in FIG. 1), handle 12 is in the fully extended position. When upper hole 32 is aligned with spring pin 24 (as seen in FIG. 2), handle 12 is in the collapsed position. To move outer tube 18 from the extended position to the collapsed position (FIG. 2), spring pin 24 is pressed out of lower hole 30 of outer tube 18 by the user. Once spring pin 24 is removed from lower hole 30, outer tube 18 is free to slide along and over lower tube 16. Additional holes may be disposed along outer tube 18 such that handle 12 is slidable between more than one extended position.

Foot 14 has a central portion 34, a first sloped portion 36, and a second sloped portion 38. Central portion 34 includes a bore (not shown) for inserting lower end 20 of inner tube 16. Central portion 34 is raised above first sloped portion 36 and second sloped portion 38. First sloped portion 36 has a different angle of slope than second sloped portion 38. Furthermore, second sloped portion 38 is truncated.

In use either sloped portion 36 or 38 is placed under a lower edge of a door. Once in place, doorstop 10 holds the door in an open position. The differing sloped portions 36 and 38 allow doorstop 10 to be used with various doors a having different spacing between the floor and the bottom of the door. Doorstop 10 is typically made of rubber. A clip 40 is mounted to upper end 28 of outer tube 18. Clip 40 is used to attach doorstop 10 to another object (such as a janitorial cart, a wheelchair or a walker for an elderly or disabled person).

FIG. 2 is a side view of doorstop 10 in the collapsed position. In the collapsed position, outer tube 18 is substantially covering inner tube 16. Upper hole 32 of outer tube 18 is aligned with spring pin 24 such that spring pin 24 can snap into upper hole 32 and hold handle 12 in the collapsed position. To move handle 12 from the collapsed position to the extended position, spring pin 24 is pressed inward and out of upper hole 32. Once spring pin 24 is removed from upper hole 32, outer tube 18 is able to slide along inner tube 16.

Figure 3:
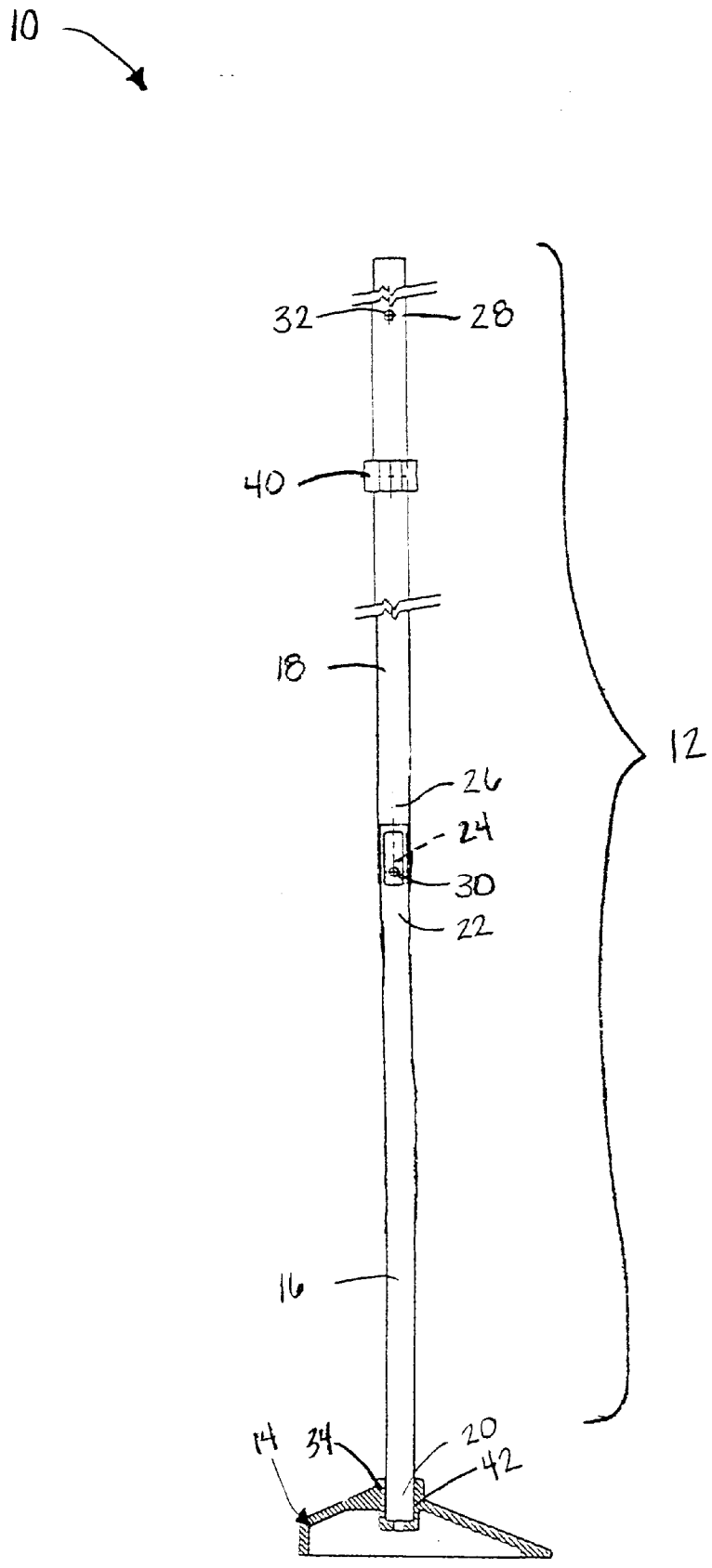
FIG. 3 is a partially sectioned sectional side view of the doorstop.

FIG. 3 illustrates a sectioned side view of doorstop 10. A bore is located in central portion 34 of foot 14. Lower end 20 of inner tube 16 is inserted into bore 42. An adhesive, such as epoxy, is used to further secure inner tube 16 within foot 14. Spring pin 24 is inserted within upper end 22 of inner tube 16. Upper end 22 of inner tube 16 also has a hole (not shown). Spring pin 24 extends through the hole of inner tube 16.

Doorstop 10 shown in FIG. 3 is in the extended position. Outer tube 18 slides over inner tube 16. In the extended position, lower hole 30 of outer tube 18 is aligned with spring pin 24. Spring pin 24 extends through lower hole 30 and snaps into position to hold handle 12 fixed in the extended position. Other spring means may be used to hold handle 12 in a fixed position, including a spring bias. For example, a spring bias can be included which causes handle 12 to extend when spring pin 24 is pressed.

Figure 4:
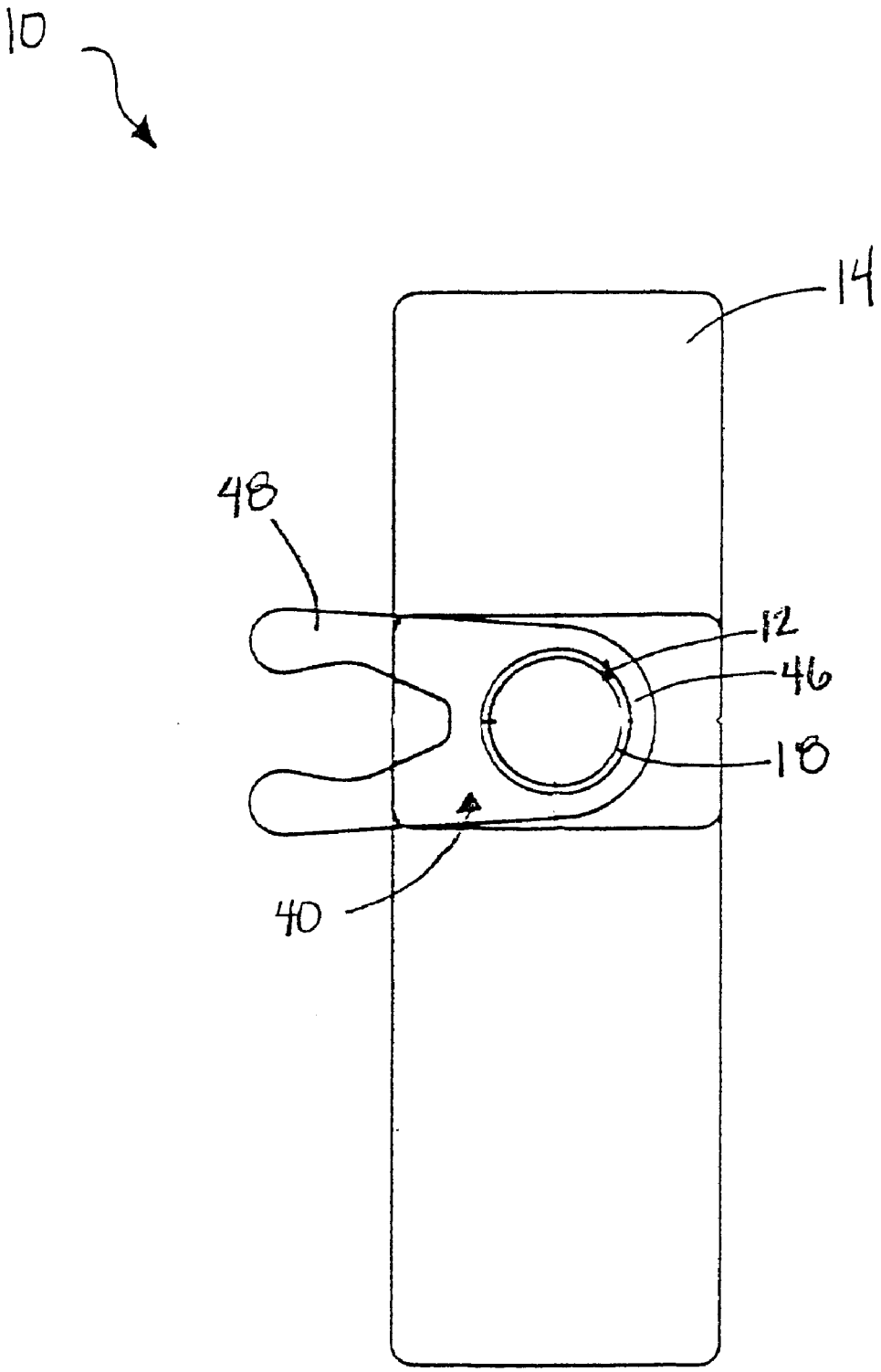
FIG. 4 is a top view of the doorstop.

FIG. 4 is a top view of doorstop 10. Clip 40 includes a clip mount 46 and a spring clip 48. Clip mount 46 is mounted to outer tube 18 of handle 12. Clip 40 is preferably mounted to outer tube 18 with an adhesive, such as epoxy. Clip 40 is mounted to outer tube 18 of doorstop 10. Spring clip 48 extends from clip mount 46. Spring clip 48 allows the user to connect doorstop 10 onto a circular pole. The circular pole could be used in conjunction with many objects, including a walker, a wheelchair or a maintenance cart.

Figure 5A:
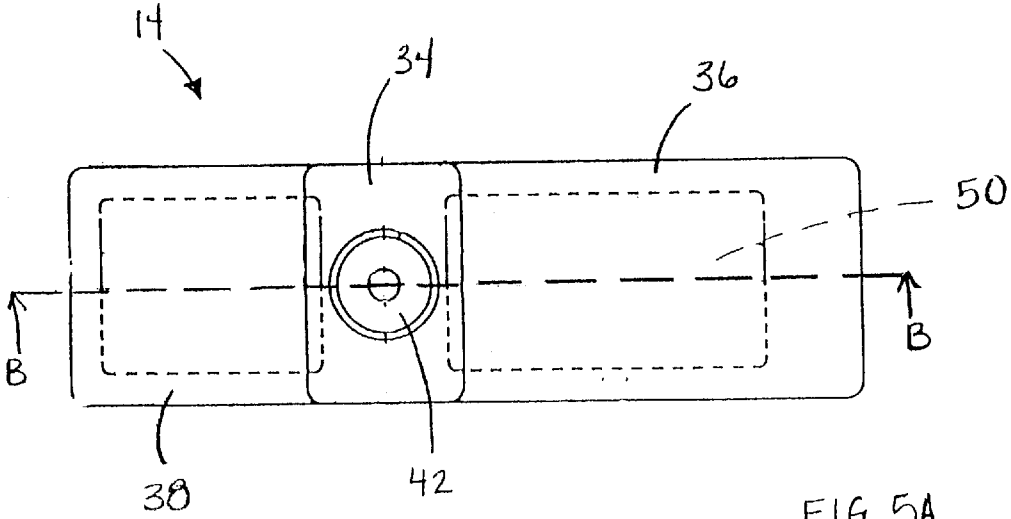
FIG. 5A is a top view of a foot of the doorstop.
Figure 5B:
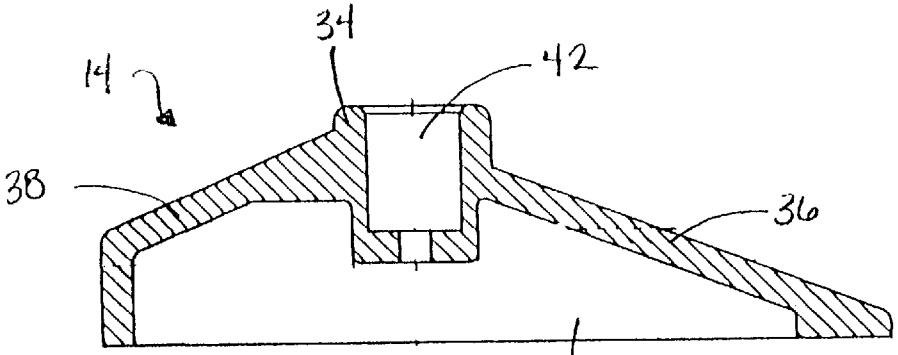
FIG. 5B is a sectional view of the foot of the doorstop taken along line B—B of FIG. 5A.

FIGS. 5A and 5B are a top view and sectional view respectively of foot 14. Bore 42 is located in central portion 34 of foot 14. Bore 42 does not extend all the way through central portion 34 of foot 14. Preferably, first sloped portion 36 of foot 14 has a smaller length than second sloped portion 38 of foot 14.

First sloped portion 36 of foot 14 has a smaller angle of slope than second sloped portion 38. Foot 14 is preferably made of rubber. Foot 14 is made through either an injection molding or an extrusion process. A cavity 50 is formed on the underside of foot 14.

Figure 6B:
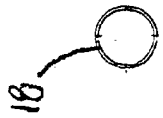
FIG. 6B is an end view of the outer tube of the doorstop.
Figure 6A:
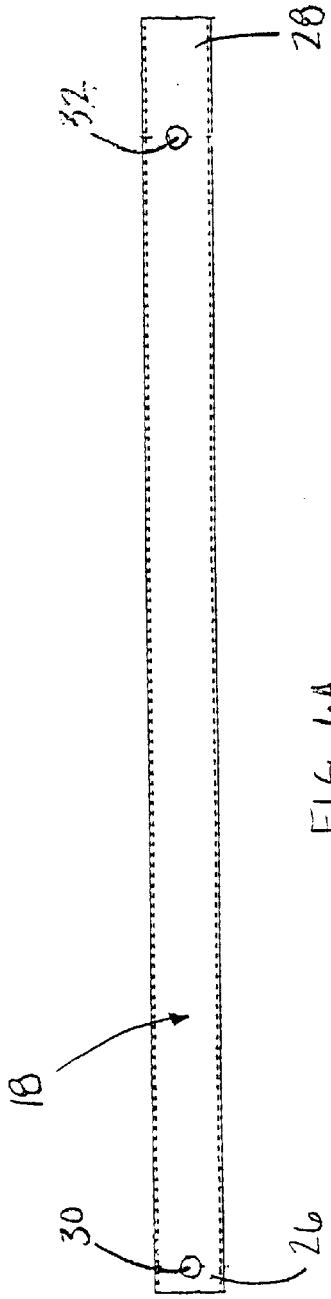
FIG. 6A is a front view of an outer tube of the doorstop.

FIGS. 6A and 6B show a front and an end view respectively of outer tube 18. Lower hole 30 is located at lower end 26 of outer tube 18 and upper hole 32 is located at upper end 28 of outer tube 18. Lower hole 30 and upper hole 32 preferably extend through only one side of outer tube 18. Outer tube 18 has a length preferably between approximately 13 inches and approximately 18 inches.

Figure 7B:
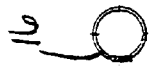
FIG. 7B is an end view of the inner tube of the doorstop.
Figure 7A:
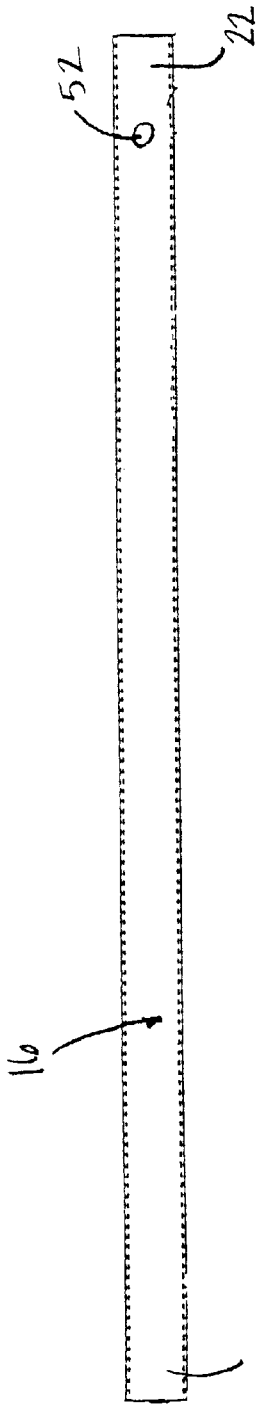
FIG. 7A is a front view of an inner tube of the doorstop.

FIGS. 7A and 7B show a front and an end view respectively of inner tube 16. Inner tube 16 has a hole 52 at upper end 22. Hole 52 extends through inner tube 16 on only one side. Inner tube 16 has a length preferably between approximately 14 inches and approximately 19 inches. Inner tube 16 has a smaller diameter than outer tube 18 to allow outer tube 18 to slide freely over inner tube 16 without excessive wobble.

Figure 8:
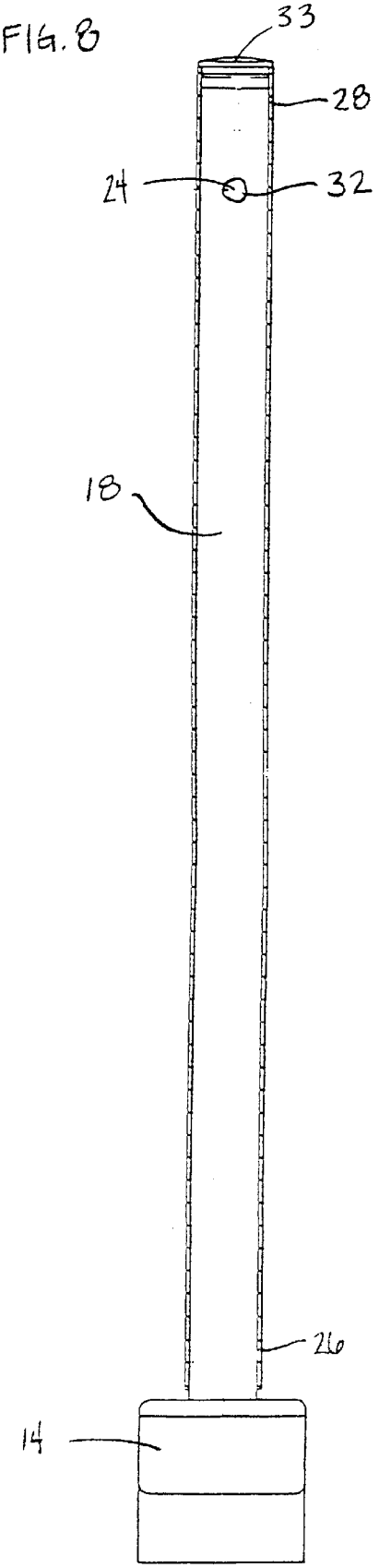
FIG. 8 is a rear sectional view of a fully assembled doorstop in the collapsed position.
Figure 9:
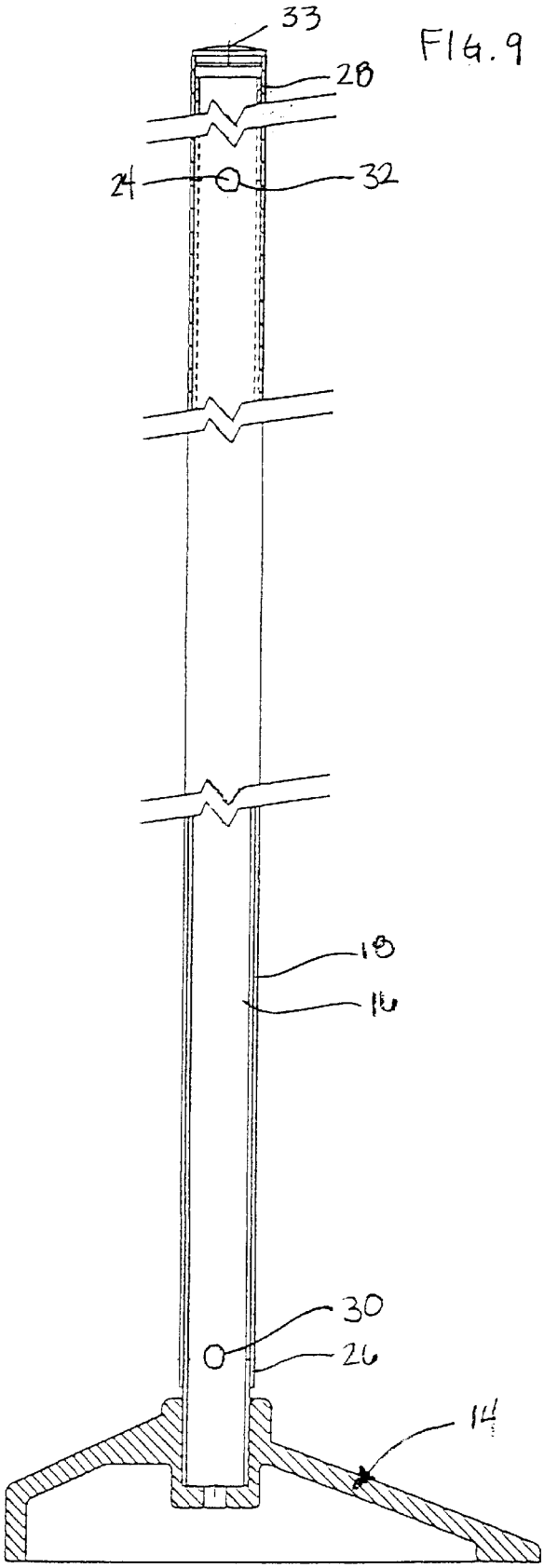
FIG. 9 is a side sectional view of the fully assembled doorstop in the collapsed position.

FIGS. 8 and 9 show rear and side sectional views, respectively of doorstop 10 in the collapsed position. Outer tube 18 slides over inner tube 16. In the collapsed position, upper hole 32 of outer tube 18 is aligned with spring pin 24. Spring pin 24 extends through upper hole 32 and snaps into position to hold handle 12 fixed in the collapsed position. In the collapsed position, doorstop 10 has a height between approximately 14 inches and approximately 23 inches.

To move handle 12 from the collapsed position to the extended position, spring pin 24 is pressed inward and out of upper hole 32 of outer tube 18. Outer tube 18 is then allowed to slide along and over inner tube 16. Outer tube 18 is able to slide until lower hole 30 becomes aligned with spring pin 24 and spring pin 24 snaps into lower hole 30. Once spring pin 24 extends through lower hole 30, handle 12 is fixed in the extended position. In the extended position, doorstop 10 has a height between approximately 28 inches and approximately 34 inches.

Figure 10B:
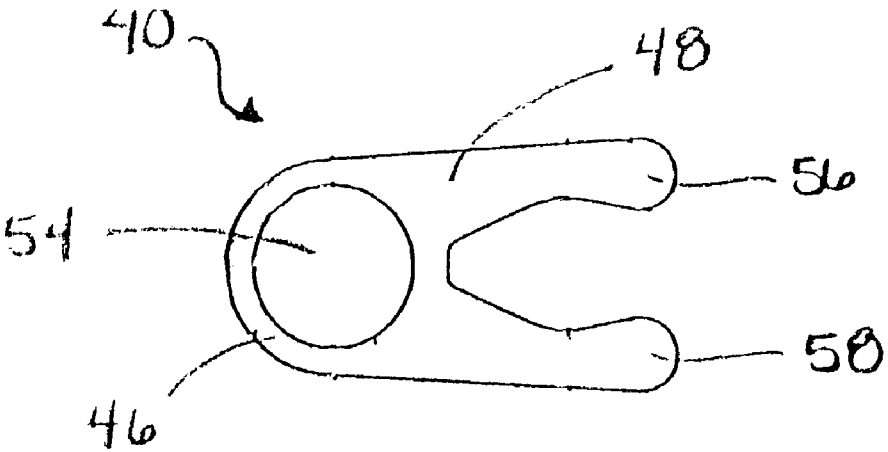
FIG. 10B is a top view of a clip.
Figure 10A:
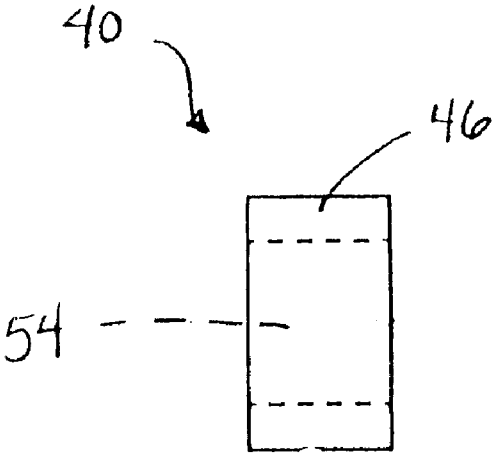
FIG. 10A is a front view of a clip.

FIGS. 10A and 10B show a front and top views respectively of clip 40. Clip mount 46 has a circular bore 54. To mount clip 40, outer tube 18 is inserted into bore 54. An adhesive is used to secure clip 40 to outer tube 18. Spring clip 48 has a first arm 56 and a second arm 58. When spring clip 48 is connected or snapped onto another object, first arm 56 and second arm 58 encircle that object.

The present invention doorstop has advantages over the doorstops currently used. Doorstop 10 prevents back injuries caused by repetitive bending down to the floor by the user to place a doorstop in position. The repeated action of bending down to the floor to place the doorstop puts a stress on the users back and can lead to back injuries for the individual. The inventive doorstop 10 is placed in position while the user is in the standing position and does not require the user to bend down to place the doorstop in position. In addition, doorstop 10 is portable and can be clipped onto other objects and carried from site to site for use.

Currently used doorstops are frequently kicked into position under the lower edge of the door thereby causing damage to the door. Oftentimes, doorstops are not used at all and damage is caused to the door by the user trying to force an object through the doorway without the door being held open. The inventive doorstop 10 is easy to use and is portable. Its ease of use increases the likelihood that a user will use a doorstop thereby eliminating damage to the door from non use. Furthermore, the foot of the doorstop is made of rubber. A user kicking the doorstop into place will not damage the lower edge of the door because of the rubber material of the foot of the doorstop.

Although the present invention has been described with reference to preferred embodiments, workers skilled in the art will recognize that changes may be made in form and detail without departing from the spirit and scope of the invention. For example, various lengths of inner tube and outer tube may be used. Furthermore, other spring means may be used to hold the handle in a fixed position and also to bias the handle into an extended or a collapsed position.

What is claimed is:

1. A doorstop comprising:

a telescoping handle; and a foot mounted at a lower end of the handle wherein the foot is insertable under a lower edge of a door, the lower edge located adjacent floor level, wherein the foot comprises:

a first sloped portion at one end of the foot;

second sloped portion at an opposite end of the foot wherein the second sloped portion has a different slope than the first sloped portion; and a central portion raised between the first and second sloped portions wherein the central portion has a vertical bore adapted for receiving the lower end of the handle.

2. The doorstop of claim 1 wherein the handle comprises:

an inner tube having an upper end and a lower end, the lower end of the inner tube mounted to the foot and the upper end having a hole;

a spring pin disposed within the inner tube and extending through the hole of the inner tube; and an outer tube that slides over the inner tube and is slidable between a collapsed position and at least one extended position.

3. The doorstop of claim 2 wherein the outer tube includes an upper end having a first hole and a lower end having a second hole such that when the upper tube is in the collapsed position the spring pin extends through the first hole and when the upper tube is in the extended position the spring pin extends through the second hole.

4. The doorstop of claim 1, and further comprising:

a clip mounted to the handle.

5. The doorstop of claim 1 wherein the telescoping handle has a length in the collapsed position between about 14 inches and about 23 inches and in the extended position the length is between about 28 inches and about 34 inches.

6. The doorstop of claim 1 wherein the upper tube includes a first hole located at the upper end of the outer tube such that when the outer tube is in the collapsed position the spring pin extends through the first hole.

7. The doorstop of claim 6 wherein the outer tube further comprises a second hole located at the lower end of the outer tube such that when the outer tube is in the extended position the spring pin extends through the second hole.

8. The doorstop of claim 7 wherein the outer tube, the inner tube and the spring pin are arranged so as to require the spring pin to be pressed to permit the outer tube to slide between the collapsed position and the extended position.

9. A doorstop comprising:

a foot for insertion under a lower edge of a door, the lower edge adjacent floor level, wherein the foot comprises:

a first sloped portion at one end of the foot;

a second sloped portion at an opposite end of the foot wherein the second sloped portion has a different slope than the first sloped portion; and a central portion raised between the first and second sloped portions wherein the central portion has a vertical bore adapted for receiving the lower end of the handle; and a handle connected at a lower end to the foot, the handle comprising:

an inner tube having a lower end mounted to the foot;

a spring pin disposed within the inner tube; and an outer tube that slides over the inner tube and is slidable between a collapsed position and at least one extended position.

10. The doorstop of claim 9 wherein the spring pin secures the outer tube in the collapsed position or the extended position.

11. A doorstop comprising:

a foot having a top surface, the foot for insertion under a lower edge of a door with the lower edge being adjacent floor level, wherein the foot comprises:

a first sloped portion at one end of the foot;

a second sloped portion at an opposite end of the foot wherein the first and second sloped portions have differing slopes; and a central portion between the sloped regions, the central portion having a vertical bore adapted for receiving the lower end of the inner tube, an inner tube having a lower end and an upper end, the lower end being attached to the top surface of the foot and the upper end having a hole;

a spring pin disposed within the inner tube and extending through the hole of the inner tube; and an outer tube having a lower end and an upper end wherein the outer tube coaxially slides over the inner tube and the outer tube is slidable between a collapsed position and at least one extended position.

12. The doorstop of claim 11, and further comprising:

a clip mounted to the outer tube for securing the doorstop to another object.

13. The doorstop of claim 11, and further comprising:

a spring disposed within the outer tube wherein the spring biases the outer tube into the extended position when the spring pin is pressed.

14. The doorstop of claim 11 wherein when the outer tube is in the extended position the outer tube and the inner tube have a combined length between about 28 inches and about 34 inches.

* * * * *